US005926899A

United States Patent [19]

Scott

[11] Patent Number: 5,926,899

[45] Date of Patent: Jul. 27, 1999

[54] TOOTHBRUSH WITH A PROTECTIVE COVERING

[76] Inventor: Tony Curtis Scott, 51 Carbarrue Ave., West Concord, N.C. 28025

[21] Appl. No.: 08/927,514

[22] Filed: Sep. 11, 1997

[51] Int. Cl.[6] ..... A46B 17/08

[52] U.S. Cl. ..... 15/167.1; 15/110; 15/175

[58] Field of Search ..... 15/167.1, 175, 15/184, 110

[56] References Cited

U.S. PATENT DOCUMENTS

| | | | |
|---|---|---|---|
| 1,188,823 | 6/1916 | Plank | 15/110 |
| 1,251,250 | 12/1917 | Libby | 15/110 |
| 1,993,662 | 9/1935 | Green | 15/110 |
| 2,253,210 | 8/1941 | Psiharis | 15/110 |
| 3,553,759 | 1/1971 | Kramer et al. | 15/110 |
| 5,799,355 | 9/1998 | Burch et al. | 15/167.1 |

*Primary Examiner*—Elizabeth McKane

[57] ABSTRACT

A new toothbrush with a protective covering for the purpose of safely brushing one's teeth and reducing the risk of injury to the gums. The inventive device includes a handle, a brushing region, a bristle portion, a bristle cluster extending from the bristle portion, and a protective covering surrounding the brushing region. The protective covering reduces the risk of bleeding in the user's mouth that results from brushing one's teeth, which therefore reduces the transmittal of diseases carried in the blood.

9 Claims, 4 Drawing Sheets

TOOTHBRUSH WITH A PROTECTIVE COVERING

BACKGROUND OF THE INVENTION

1. Field of the Invention

The present invention relates to toothbrushes and more particularly pertains to a new toothbrush with a protective covering for safely brushing one's teeth and reducing the risk of injury to the gums.

2. Description of the Prior Art

The use of toothbrushes is known in the prior art. More specifically, toothbrushes heretofore devised and utilized are known to consist basically of familiar, expected and obvious structural configurations, notwithstanding the myriad of designs encompassed by the crowded prior art which have been developed for the fulfillment of countless objectives and requirements.

Known prior art toothbrushes include U.S. Pat. No. 5,342,284; U.S. Pat. No. 5,369,831; U.S. Pat. No. 4,766,633; U.S. Pat. No. 5,302,374; U.S. Pat. No. 5,138,733; and U.S. Pat. No. 4,630,326.

While these devices fulfill their respective, particular objectives and requirements, the aforementioned patents do not disclose a new toothbrush with a protective covering. The inventive device includes a handle, a brushing region, a bristle portion, a bristle cluster extending from the bristle portion, and a protective covering surrounding the brushing region.

In these respects, the toothbrush with a protective covering according to the present invention substantially departs from the conventional concepts and designs of the prior art, and in so doing provides an apparatus primarily developed for the purpose of safely brushing one's teeth and reducing the risk of injury to the gums.

SUMMARY OF THE INVENTION

In view of the foregoing disadvantages inherent in the known types of toothbrushes now present in the prior art, the present invention provides a new toothbrush with a protective covering construction wherein the same can be utilized for safely brushing one's teeth and reducing the risk of injury to the gums.

The general purpose of the present invention, which will be described subsequently in greater detail, is to provide a new toothbrush with a protective covering apparatus and method which has many of the advantages of the toothbrushes mentioned heretofore and many novel features that result in a new toothbrush with a protective covering which is not anticipated, rendered obvious, suggested, or even implied by any of the prior art toothbrushes, either alone or in any combination thereof.

To attain this, the present invention generally comprises a handle, a brushing region, a bristle portion, a bristle cluster extending from the bristle portion, and a protective covering surrounding the brushing region.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new toothbrush with a protective covering apparatus and method which has many of the advantages of the toothbrushes mentioned heretofore and many novel features that result in a new toothbrush with a protective covering which is not anticipated, rendered obvious, suggested, or even implied by any of the prior art toothbrushes, either alone or in any combination thereof.

It is another object of the present invention to provide a new toothbrush with a protective covering, which may be easily and efficiently manufactured and marketed.

It is a further object of the present invention to provide a new toothbrush with a protective covering, which is of a durable and reliable construction.

An even further object of the present invention is to provide a new toothbrush with a protective covering which is susceptible of a low cost of manufacture with regard to both materials and labor, and which accordingly is then susceptible of low prices of sale to the consuming public, thereby making such toothbrush with a protective covering economically available to the buying public.

Still yet another object of the present invention is to provide a new toothbrush with a protective covering which provides in the apparatuses and methods of the prior art some of the advantages thereof, while simultaneously overcoming some of the disadvantages normally associated therewith.

Still another object of the present invention is to provide a new toothbrush with a protective covering for safely brushing one's teeth and reducing the risk of injury to the gums.

Yet another object of the present invention is to provide a new toothbrush with a protective covering which includes a handle, a brushing region, a bristle portion, a bristle cluster extending from the bristle portion, and a protective covering surrounding the brushing region.

Still yet another object of the present invention is to provide a new toothbrush with a protective covering that is designed to prevent the user from injury while the user brushes his or her teeth.

Even still another object of the present invention is to provide a new toothbrush with a protective covering that reduces bleeding associated with brushing of the teeth, thereby reducing the spread of diseases transmitted through the blood.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 3:
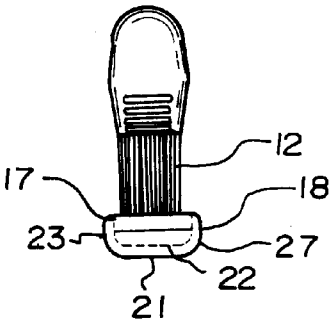
FIG. 3 is a front view of the present invention.

With reference now to the drawings, and in particular to FIGS. 1 through 11 thereof, a new toothbrush with a protective covering embodying the principles and concepts of the present invention and generally designated by the reference numeral 10 will be described.

As best illustrated in FIGS. 1 through 11, the toothbrush with a protective covering 10 comprises a handle 11, a brushing region 13, a bristle portion 14, a bristle cluster 12 extending from the bristle portion 14, and a protective covering 20 surrounding the brushing region 13. The toothbrush with a protective covering 10 is designed to protect the user from injury while the user brushes his or her teeth.

Figure 1:
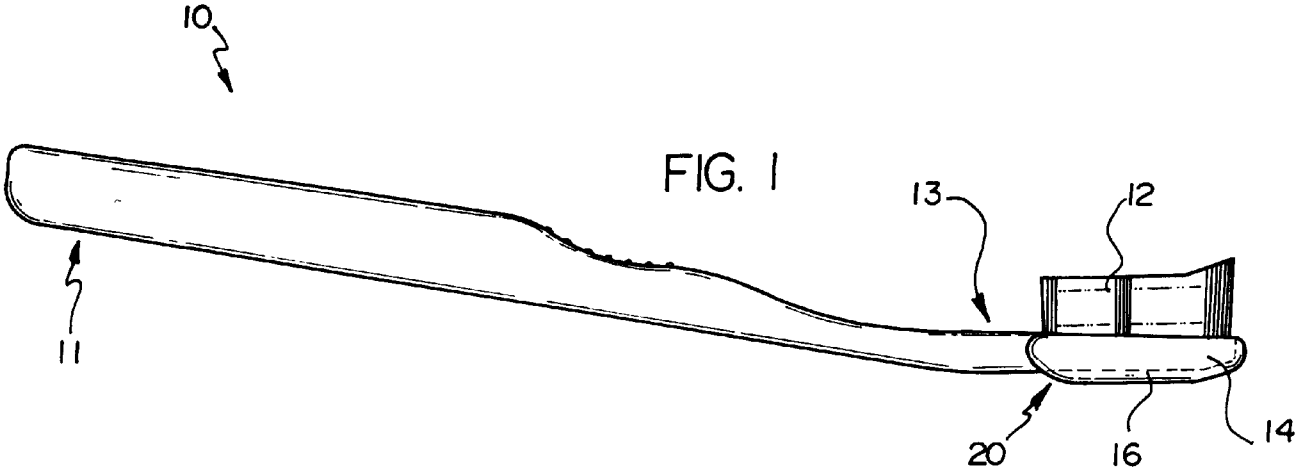
FIG. 1 is a side view of a new toothbrush with a protective covering according to the present invention.
Figure 2:
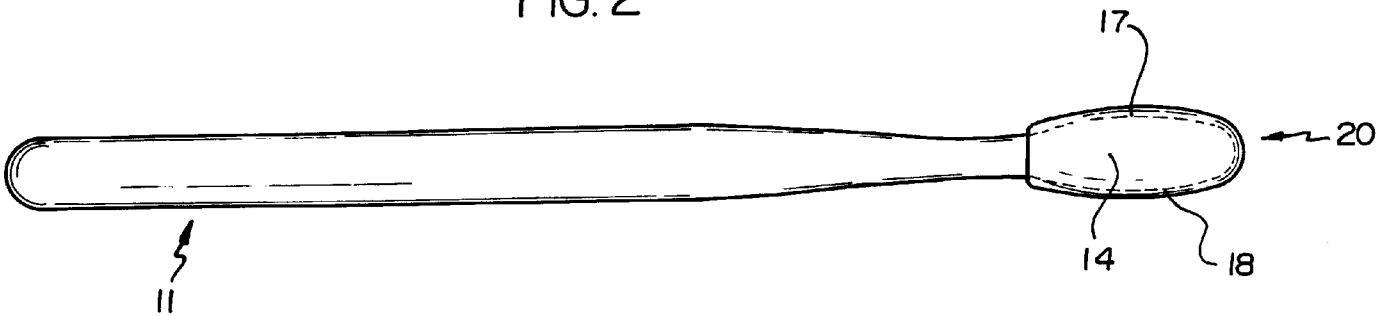
FIG. 2 is a bottom view of the present invention.

The handle 11 has a brushing region, which includes a bristle portion 14. The bristle portion 14 has an upper surface 15, a back side 16, a first side 17, and a second side 18. As shown in FIG. 1, the bristle cluster 12 extends from the upper surface 15 of the bristle portion 14.

The protective covering 20 surrounds the bristle portion 14 covering the back side 16, the first side 17, and the second side 18. The protective covering 20 is defined by a back portion 21, a first wall 23, and a second wall 27. The first 23 and second 27 walls extend from the back portion 21 to conform with the shape of the bristle portion 14. Ideally, the protective covering 20 is constructed from a soft material such as rubber or soft plastic.

The back portion 21 of the protective covering 20 has an inner surface 22. As shown in FIG. 3, the back portion inner surface 22 is coupled to the back side 16 of the bristle portion 14. The first wall inner surface 24 is coupled to the first side 17 and, in a similar fashion, the second wall inner surface 28 is coupled to the second side 18.

Figure 4:
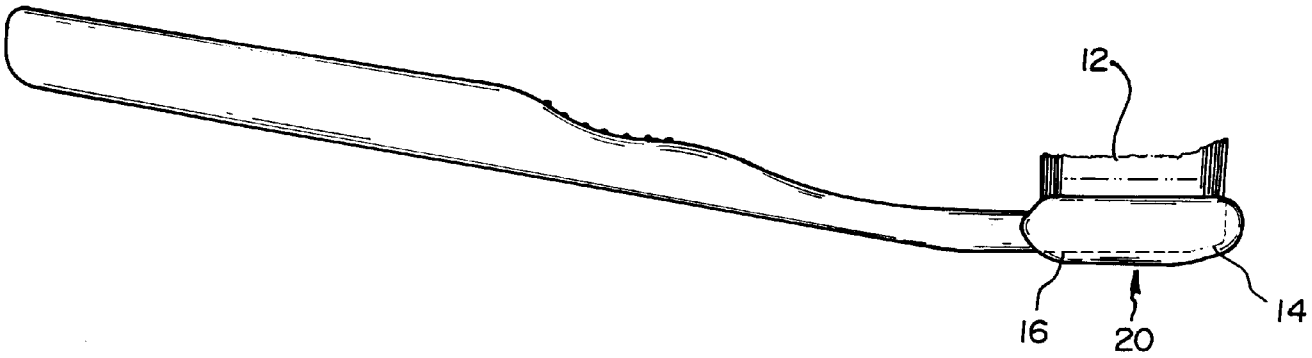
FIG. 4 is a side view of the present invention showing the insertion of a toothbrush into the protective covering.
Figure 6:
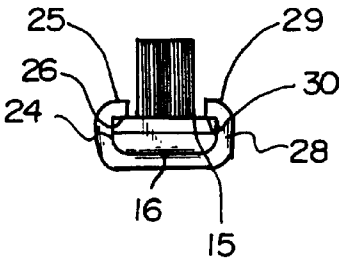
FIG. 6 is a front view of a toothbrush with the protective covering.
Figure 5:
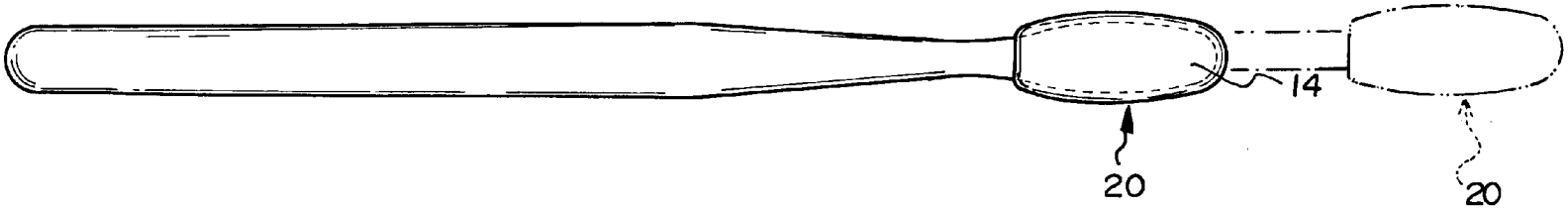
FIG. 5 is a bottom view of a toothbrush with the protective covering.

In an optional embodiment, the protective covering 20 is slidably fitted to the brushing region 13 of a toothbrush 1. As shown in FIG. 4, the protective covering slides onto the bristle portion 14 and conforms to the shape thereof. As shown in FIG. 6, the back portion inner surface 22 abuts against the back side 16. Further, the first wall inner surface 24 abuts against the first side 17 and the second wall inner surface 28 similarly abuts against the second side 18. Preferably, the first wall 23 has a first lip 25 to help securely grip the upper surface 15 of the bristle portion 14. The inner surface 26 of the first lip 25 abuts the upper surface 15 of the bristle portion 14. Also preferably, the second wall 27 has a second lip 29 to help securely grip the upper surface 15. The inner surface 30 of the second lip 29 also abuts the upper surface 15 of the bristle portion 14. As shown in FIG. 6, the bristle cluster 12 extends from the upper surface 15 of the bristle portion 14 and in between the first 25 and second 29 lip of the protective covering side walls 23,27.

Figure 9:
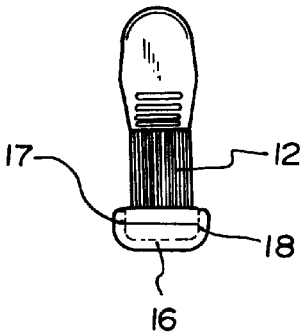
FIG. 9 is a front view of the present invention with the V-shaped notch protective covering.
Figure 7:
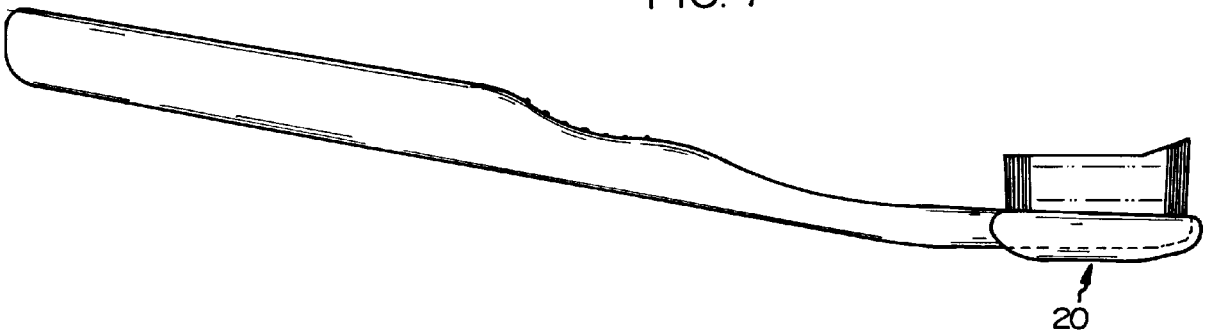
FIG. 7 is a side view of the present invention showing the insertion of a toothbrush into the V-shaped notch protective covering.
Figure 8:
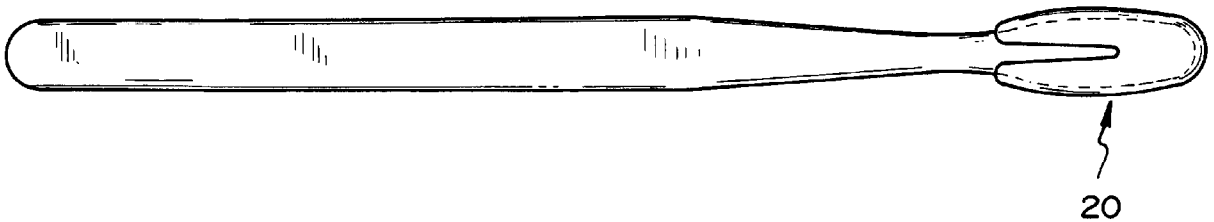
FIGS. 8, 10, and 11 are bottom views of the present invention with the V-shaped notch protective covering.
Figure 10:
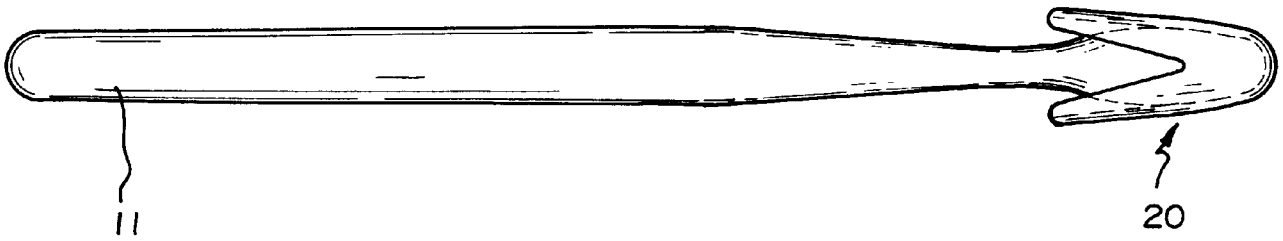
Figure 11:
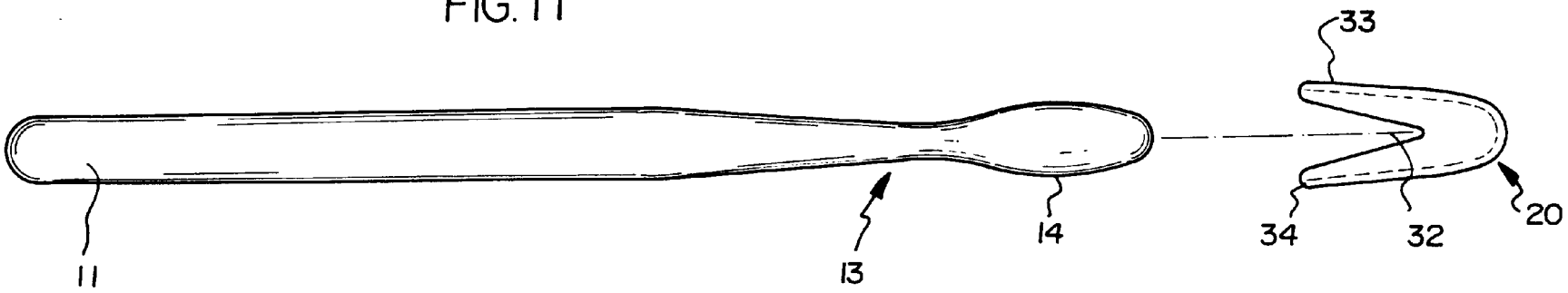

In another optional embodiment, as shown in FIGS. 7,8, and 9, the protective covering 20 has a V-shaped notch 32 with a first branch 33 and a second branch 34. The V-shaped notch 32 permits the protective covering 20 slides onto the bristle portion 14 with relatively little interference. The first 33 and second 34 branch are compressible so as to conform to the shape of the bristle portion 14. Preferably, the protective covering 20 is secured to the bristle portion 14 by an adhesive applied to the inner surfaces 22, 24, 28 of the protective covering 20.

In summary, the toothbrush with a protective covering 10 is used as an ordinary toothbrush. The protective covering 20 prevents injury to a person's mouth while allowing the bristle cluster 12 to clean the teeth and gum line. Preferably, the protective covering 20 may be fitted over the bristle portion 13 as shown in FIG. 6. Optionally, the protective covering 20 may have a V-notch to aid in sliding the protective covering 20 over the bristle portion 14 and an adhesive to securely attach the protective covering 20 thereto, as shown in FIG. 7. Ideally, the protective covering 20 is permanently molded onto a toothbrush 1 as shown in FIG. 3.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A toothbrush, comprising:

a handle having a brushing region with a bristle portion, said bristle portion having an upper surface, a back side, a first side, a second side, and a front side;

a bristle cluster extending from said bristle portion of said handle, said bristle cluster being extended from said bristle portion upper surface;

a protective covering being formed onto the surface of said bristle portion covering said back side, said first side, said second side, and said front side of said bristle portion;

said protective covering having a back portion and spaced apart first and second walls extending from said back portion, said back portion, said first wall, said second wall, and said end wall forming a pocket therebetween for receiving the bristle portion of a toothbrush, said first wall and said second wall define an opening opposite said end wall for receiving the bristle portion into said pocket; and said back portion having a V-shaped notch therein such that said back portion is divided into a first branch and a second branch, said V-shaped notch being for helping fit a toothbrush into said pocket of said protective covering.

2. A protective covering for the brushing region of a toothbrush of the type having a handle with a bristle portion having an upper surface, a back side, a first side, a second side, and a front side, said protective covering comprising:

a back portion having an inner surface for positioning adjacent to the back side of the bristle portion of a toothbrush;

a first wall having an inner surface, said first wall being extended from said back portion for positioning adjacent to the first side of the bristle portion of a toothbrush;

a second wall having an inner surface being extended from said back portion for positioning adjacent to the second side of the bristle portion of a toothbrush;

an end wall having an inner surface being extended from said back portion for positioning adjacent to the front side of the bristle portion of a toothbrush, said end wall linking said first wall and said second wall;

said back portion, said first wall, said second wall, and said end wall forming a pocket therebetween for receiving the bristle portion of a toothbrush, said first wall and said second wall define an opening opposite said end wall for receiving the bristle portion into said pocket; and said back portion having a V-shaped notch therein such that said back portion is divided into a first branch and a second branch, said V-shaped notch being for helping fit a toothbrush into said pocket.

3. The protective covering of claim 2, further comprising a first lip and a second lip each having an inner surface, said first lip being extended from said first wall, said second lip being extended from said second wall, each of said lips being extended substantially parallel to said back portion and extending toward other said lip, said first lip and said second lip being spaced in a substantial parallel relationship to permit extension of the bristle cluster from the upper surface of the bristle portion of a toothbrush.

4. The protective covering of claim 3 further comprising a toothbrush, wherein said first lip inner surface is secured on the upper surface, and said second lip inner surface is coupled on the upper surface.

5. A protective covering for the brushing region of a toothbrush of the type having a handle with a bristle portion having an upper surface, a back side, a first side, a second side, and a front side, said protective covering comprising:

a back portion having an inner surface for positioning adjacent to the back side of the bristle portion of a toothbrush;

a first wall having an inner surface, said first wall being extended from said back portion for positioning adjacent to the first side of the bristle portion of a toothbrush;

a second wall having an inner surface being extended from said back portion for positioning adjacent to the second side of the bristle portion of a toothbrush;

an end wall having an inner surface being extended from said back portion for positioning adjacent to the front side of the bristle portion of a toothbrush said end wall linking said first wall and said second wall;

said back portion, said first wall, said second wall, and said end wall forming a pocket therebetween for receiving the bristle portion of a toothbrush, said first wall and said second wall define an opening opposite said end wall for receiving the bristle portion into said pocket; and wherein said back portion has a V-shaped notch therein such that said back portion is divided into a first branch and a second branch, said V-shaped notch being for helping fit a toothbrush into the pocket of said protective covering, said first branch and said second branch being flexible to conform said first branch and said second branch to the shape of the bristle portion of a toothbrush.

6. The protective covering of claim 5, wherein said inner surface of said protective covering has an adhesive thereon for aiding the securing the protective covering to the bristle portion of a toothbrush.

7. A protective covering for the brushing region of a toothbrush of the type having a handle with a bristle portion having an upper surface, a back side, a first side, a second side, and a front side, said protective covering comprising:

a back portion having an inner surface for positioning adjacent to the back side of the bristle portion of a toothbrush;

a first wall extending from said back portion having an inner surface for positioning adjacent to the first side of the bristle portion of a toothbrush;

a second wall extending from said back portion having an inner surface for positioning adjacent to the second side of the bristle portion of a toothbrush;

an end wall extending from said back portion having an inner surface for positioning adjacent to the front side of the bristle portion of a toothbrush, said end wall linking said first wall and said second wall;

wherein said first wall and said second wall define an opening opposite said end wall for receiving the bristle portion, said back portion, said first wall, said second wall, and said end wall forming a pocket therebetween for receiving the bristle portion;

said back portion having a V-shaped notch therein such that said back portion is divided into a first branch and a second branch, said V-shaped notch being for helping fit a toothbrush into said pocket;

a first lip having an inner surface, said first lip being extended from said first wall, said first lip extending substantially parallel to said back portion, said first lip inner surface being secured on the upper surface, said first lip having an inner edge; and a second lip having an inner surface, said second lip being extended from said second wall, said second lip extending substantially parallel to said back portion, said second lip inner surface is secured on said upper surface, said second lip having an inner edge, said inner edges of said first lip and said second lip being spaced in a substantial parallel relationship to permit the bristle cluster to extend from the upper surface of the bristle portion.

8. The protective covering of claim 7, wherein said first branch and said second branch is flexible to conform said first branch and said second branch to the shape of the bristle portion of a toothbrush.

9. The protective covering of claim 7, wherein said inner surface of said protective covering has an adhesive thereon for aiding the securing the protective covering to the bristle portion of a toothbrush.

* * * * *